US011335262B2

(12) United States Patent
Sun et al.

(10) Patent No.: US 11,335,262 B2
(45) Date of Patent: May 17, 2022

(54) PIXEL CIRCUIT, CONTROL METHOD FOR THE SAME AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Jia Sun, Beijing (CN); Sijun Lei, Beijing (CN); Xianyong Gao, Beijing (CN); Liang Gao, Beijing (CN); Fanjian Zeng, Beijing (CN); Yansheng Sun, Beijing (CN); Yunsong Li, Beijing (CN); Huan Wu, Beijing (CN); Peng Zhang, Beijing (CN); Bo Ran, Beijing (CN); Haijun Liao, Beijing (CN)

(73) Assignees: Chongqing BOE Optoelectronics Technology Co., Ltd., Chongqing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/254,877

(22) PCT Filed: Jun. 2, 2020

(86) PCT No.: PCT/CN2020/093880
§ 371 (c)(1),
(2) Date: Dec. 22, 2020

(87) PCT Pub. No.: WO2020/253515
PCT Pub. Date: Dec. 24, 2020

(65) Prior Publication Data

US 2021/0295774 A1 Sep. 23, 2021

(30) Foreign Application Priority Data

Jun. 21, 2019 (CN) ..... 201910541367.7

(51) Int. Cl.
*G09G 3/3233* (2016.01)

(52) U.S. Cl.
CPC ... *G09G 3/3233* (2013.01); *G09G 2300/0426* (2013.01); *G09G 2310/08* (2013.01); *G09G 2320/0233* (2013.01)

(58) Field of Classification Search
CPC ..... G09G 3/3233
See application file for complete search history.

(56) References Cited

U.S. PATENT DOCUMENTS 5,668,587 A 9/1997 Hammond et al.
2006/0141685 A1 6/2006 Kim et al.
(Continued)

FOREIGN PATENT DOCUMENTS

CN 103000132 A 3/2013
CN 203054413 U 7/2013
(Continued)

*Primary Examiner* — Sanjiv D. Patel
(74) *Attorney, Agent, or Firm* — The Webb Law Firm

(57) ABSTRACT

The present disclosure provides a pixel circuit, a control method for the same, and a display device. The pixel circuit comprises a pixel driving circuit, a mode selecting circuit, and a light emitting device. The pixel driving circuit is configured to output a driving current. The mode selecting circuit is configured to select a different light emitting mode according to a different mode selecting signal. The light emitting device is configured to emit light having a different brightness according to a different light emitting mode. The light emitting device comprises a first electrode structure, a second electrode structure, and a functional layer between the first electrode structure and the second electrode struc-
(Continued)

ture. The mode selecting circuit comprises a first switching sub-circuit and a second switching sub-circuit.

7 Claims, 7 Drawing Sheets

(56) References Cited

U.S. PATENT DOCUMENTS

| | | | | |
|---|---|---|---|---|
| 2019/0081261 | A1* | 3/2019 | Lee | C09K 11/08 |
| 2019/0108790 | A1* | 4/2019 | Liang | G09G 3/3233 |
| 2019/0386033 | A1 | 12/2019 | Li et al. | |
| 2020/0135107 | A1* | 4/2020 | Yan | G09G 3/3258 |

FOREIGN PATENT DOCUMENTS

| | | | |
|---|---|---|---|
| CN | 107644948 | A | 1/2018 |
| CN | 108538241 | A | 9/2018 |
| CN | 108831912 | A | 11/2018 |
| CN | 109545134 | A | 3/2019 |
| CN | 109817159 | A | 5/2019 |
| CN | 110264956 | A | 9/2019 |
| JP | H07276706 | A | 10/1995 |

* cited by examiner

PIXEL CIRCUIT, CONTROL METHOD FOR THE SAME AND DISPLAY DEVICE

CROSS-REFERENCE TO RELATED APPLICATIONS

The present disclosure is a U.S. National Stage Application under 35 U.S.C. § 371 of International Patent Application No. PCT/CN2020/093880, filed on Jun. 2, 2020, which claims priority to Chinese Patent Application No. 201910541367.7 filed on Jun. 21, 2019, the disclosure of both of which are incorporated by reference herein in entirety.

TECHNICAL FIELD

The present disclosure relates to a pixel circuit, a control method for the same, and a display device.

BACKGROUND

Currently, the AMOLED (Active-matrix organic light-emitting diode) display technology is more and more widely applied. For example, in the pixel circuit structure of the related art, when a data signal is input to the pixel circuit, the driving transistor may output a driving current. The driving current can drive a light emitting device (for example, OLED (Organic Light Emitting Diode)) to emit light. The magnitude of the driving current may be controlled by controlling a voltage difference between the data signal and a power supply voltage, so that the brightness of the display of the light emitting device can be controlled.

SUMMARY

According to an aspect of embodiments of the present disclosure, a pixel circuit is provided. The pixel circuit comprises: a pixel driving circuit configured to output a driving current; a light emitting device configured to emit light having a different brightness according to a different light emitting mode under driving of the driving current and comprising a first electrode structure, a second electrode structure, and a functional layer between the first electrode structure the second electrode structure; and a mode selecting circuit configured to select a different light emitting mode according to a different mode selecting signal and comprising: a first switching sub-circuit electrically connected to the pixel driving circuit and the first electrode structure and configured to perform a different first conduction mode in response to a different mode selecting signal; and a second switching sub-circuit electrically connected to a first voltage terminal and the second electrode structure and configured to perform a different second conduction mode in response to a different mode selecting signal; wherein the mode selecting circuit is configured to determine the light emitting mode according to the first conduction mode and the second conduction mode.

In some embodiments, the functional layer comprises a light emitting layer; and at least one of the first electrode structure or the second electrode structure comprises a plurality of electrodes spaced apart from each other.

In some embodiments, the first electrode structure comprises a plurality of first electrodes spaced apart from each other; and the second electrode structure comprises a plurality of second electrodes spaced apart from each other.

In some embodiments, the light emitting device is on an initial structure layer; and the plurality of first electrodes comprise a first sub-electrode and a second sub-electrode, the plurality of second electrodes comprise a third sub-electrode and a fourth sub-electrode, an orthographic projection of the first sub-electrode on the initial structure layer at least partially overlaps with an orthographic projection of the third sub-electrode on the initial structure layer, and an orthographic projection of the second sub-electrode on the initial structure layer at least partially overlaps with an orthographic projection of the fourth sub-electrode on the initial structure layer.

In some embodiments, the first switching sub-circuit comprises a first switching device and at least one first switching transistor, and the second switching sub-circuit comprises a second switching device and at least one second switching transistor; and the mode selecting signal comprises a first control signal for controlling the first switching device, a second control signal for controlling the second switching device, a third control signal for controlling the at least one first switching transistor, and a fourth control signal for controlling the at least one second switching transistor.

In some embodiments, a first connection terminal of the first switching device is electrically connected to the pixel driving circuit, a plurality of second connection terminals of the first switching device are electrically connected to the plurality of first electrodes of the light emitting device in one-to-one correspondence, and the first switching device is configured to connect the first connection terminal of the first switching device to one of the plurality of second connection terminals of the first switching device in response to the first control signal; one first switching transistor is provided between any two adjacent first electrodes of the plurality of first electrodes, wherein a first electrode of the one first switching transistor is electrically connected to one first electrode of the any two adjacent first electrodes, a second electrode of the one first switching transistor is electrically connected to another first electrode of the any two adjacent first electrodes, and a gate of the one first switching transistor is configured to receive the third control signal; a first connection terminal of the second switching device is electrically connected to the first voltage terminal, a plurality of second connection terminals of the second switching device are electrically connected to the plurality of second electrodes of the light emitting device in one-to-one correspondence, and the second switching device is configured to connect the first connection terminal of the second switching device to one of the plurality of second connection terminals of the second switching device in response to the second control signal; and one second switching transistor is provided between any two adjacent second electrodes of the plurality of second electrodes, wherein a first electrode of the one second switching transistor is electrically connected to one second electrode of the any two adjacent second electrodes, a second electrode of the one second switching transistor is electrically connected to another second electrode of the any two adjacent second electrodes, and a gate of the one second switching transistor is configured to receive the fourth control signal.

In some embodiments, the first switching device comprises a first PMOS transistor and a first NMOS transistor electrically connected to the first PMOS transistor; and the second switching device comprises a second PMOS transistor and a second NMOS transistor electrically connected to the second PMOS transistor.

In some embodiments, the plurality of second connection terminals of the first switching device comprise two second connection terminals, and the plurality of second connection terminals of the second switching device comprise two second connection terminals; the at least one first switching transistor comprises one first switching transistor; and the at least one second switching transistor comprises one second switching transistor.

In some embodiments, the first switching sub-circuit comprises a plurality of third switching transistors, and the second switching sub-circuit comprises a plurality of fourth switching transistors; the mode selecting signal comprises a plurality of fifth control signals and a plurality of sixth control signals; a plurality of first electrodes of the plurality of third switching transistors are electrically connected to the plurality of first electrodes of the light emitting device in one-to-one correspondence, a plurality of second electrodes of the plurality of third switching transistors are electrically connected to the pixel driving circuit, and a gate of each of the plurality of third switching transistors is configured to receive a fifth control signal corresponding to the each of the plurality of third switching transistors; and a plurality of first electrodes of the plurality of fourth switching transistors are electrically connected to the plurality of second electrodes of the light emitting device in one-to-one correspondence, a plurality of second electrodes of the plurality of fourth switching transistors are electrically connected to the first voltage terminal, and a gate of each of the plurality of fourth switching transistors is configured to receive a sixth control signal corresponding to the each of the plurality of fourth switching transistors.

In some embodiments, the plurality of third switching transistors comprise two third switching transistors; and the plurality of fourth switching transistors comprises two fourth switching transistors.

In some embodiments, the light emitting mode comprises a first light emitting mode, a second light emitting mode, and a third light emitting mode; wherein a light emitting brightness of the light emitting device in the first light emitting mode is less than a light emitting brightness of the light emitting device in the second light emitting mode, and the light emitting brightness of the light emitting device in the second light emitting mode is less than a light emitting brightness of the light emitting device in the third light emitting mode, in a case where the pixel driving circuit is input with a same grayscale data.

In some embodiments, the pixel driving circuit comprises a fifth switching transistor, a capacitor, and a driving transistor, wherein a first electrode of the fifth switching transistor is electrically connected to a data signal line, a second electrode of the fifth switching transistor is electrically connected to a gate of the driving transistor, a gate of the fifth switching transistor is electrically connected to a gate control line, a first terminal of the capacitor is electrically connected to the gate of the driving transistor, a second terminal of the capacitor is electrically connected to a second voltage terminal, a first electrode of the driving transistor is electrically connected to the second voltage terminal, and a second electrode of the driving transistor is electrically connected to the mode selecting circuit.

In some embodiments, the first sub-electrode and the second sub-electrode each have a comb-like structure, and comb teeth of the comb-like structure of the first sub-electrode are arranged to cross comb teeth of the comb-like structure of the second sub-electrode; and the third sub-electrode and the fourth sub-electrode each have a comb-like structure, and comb teeth of the comb-like structure of the third sub-electrode are arranged to cross comb teeth of the comb-like structure of the fourth sub-electrode.

In some embodiments, an area of the first sub-electrode is equal to an area of the second sub-electrode, and an area of the third sub-electrode is equal to an area of the fourth sub-electrode, in a direction parallel to an extension direction of the functional layer.

According to another aspect of the embodiments of the present disclosure, a display device is provided. The display device comprises a plurality of pixel circuits described above.

In some embodiments, the display device further comprises a timing controller configured to provide mode selecting signals to the plurality of pixel circuits in one-to-one correspondence.

According to another aspect of the embodiments of the present disclosure, a control method for a pixel circuit is provided. The pixel circuit comprises a pixel driving circuit, a mode selecting circuit and a light emitting device. The control method comprises: outputting a driving current according to a data signal by the pixel driving circuit; selecting a different light emitting mode according to a different mode selecting signal by the mode selecting circuit; and emitting light having a different brightness according to the different light emitting mode under driving of the driving current by the light emitting device.

In some embodiments, the light emitting mode comprises a first light emitting mode, a second light emitting mode, and a third light emitting mode; wherein a light emitting brightness of the light emitting device in the first light emitting mode is less than a light emitting brightness of the light emitting device in the second light emitting mode, and the light emitting brightness of the light emitting device in the second light emitting mode is less than a light emitting brightness of the light emitting device in the third light emitting mode, in a case where the pixel driving circuit is input with a same grayscale data.

In some embodiments, the light emitting device comprises: a plurality of first electrodes spaced apart from each other, a plurality of second electrodes spaced apart from each other, and a functional layer between the plurality of first electrodes and the plurality of second electrodes, the functional layer comprises a light emitting layer, and the light emitting device is on an initial structure layer, the plurality of first electrodes comprise a first sub-electrode and a second sub-electrode, the plurality of second electrodes comprise a third sub-electrode and a fourth sub-electrode, an orthographic projection of the first sub-electrode on the initial structure layer at least partially overlaps with an orthographic projection of the third sub-electrode on the initial structure layer, and an orthographic projection of the second sub-electrode on the initial structure layer at least partially overlaps with an orthographic projection of the fourth sub-electrode on the initial structure layer; and the selecting of the different light emitting mode according to the different mode selecting signal by the mode selecting circuit comprises: the mode selecting circuit controls the driving current to flow through the first sub-electrode, the functional layer and the fourth sub-electrode, or controls the driving current to flow through the second sub-electrode, the functional layer and the third sub-electrode, in response to a mode selecting signal corresponding to the first light emitting mode; the mode selecting circuit controls the driving current to flow through the first sub-electrode, the functional layer and the third sub-electrode, or controls the driving current to flow through the second sub-electrode, the functional layer and the fourth sub-electrode, in response to a mode selecting signal corresponding to the second light emitting mode; or the mode selecting circuit controls the driving current to flow through the first sub-electrode, the second sub-electrode, the functional layer, the third sub-electrode and the fourth sub-electrode, in response to a mode selecting signal corresponding to the third light emitting mode.

In some embodiments, the first switching sub-circuit comprises a first switching device and at least one first switching transistor, the second switching sub-circuit comprises a second switching device and at least one second switching transistor; the mode selecting signal comprises a first control signal for controlling the first switching device, a second control signal for controlling the second switching device, a third control signal for controlling the at least one first switching transistor, and a fourth control signal for controlling the at least one second switching transistor; a first connection terminal of the first switching device is electrically connected to the pixel driving circuit, a plurality of second connection terminals of the first switching device are electrically connected to the plurality of first electrodes of the light emitting device in one-to-one correspondence, and the first switching device is configured to connect the first connection terminal of the first switching device to one of the plurality of second connection terminals of the first switching device in response to the first control signal; one first switching transistor is provided between any two adjacent first electrodes of the plurality of first electrodes, wherein a first electrode of the one first switching transistor is electrically connected to one first electrode of the any two adjacent first electrodes, a second electrode of the one first switching transistor is electrically connected to another first electrode of the any two adjacent first electrodes, and a gate of the one first switching transistor is configured to receive the third control signal; a first connection terminal of the second switching device is electrically connected to a first voltage terminal, a plurality of second connection terminals of the second switching device are electrically connected to the plurality of second electrodes of the light emitting device in one-to-one correspondence, and the second switching device is configured to connect the first connection terminal of the second switching device to one of the plurality of second connection terminals of the second switching device in response to the second control signal; and one second switching transistor is provided between any two adjacent second electrodes of the plurality of second electrodes, wherein a first electrode of the one second switching transistor is electrically connected to one second electrode of the any two adjacent second electrodes, a second electrode of the one second switching transistor is electrically connected to another second electrode of the any two adjacent second electrodes, and a gate of the one second switching transistor is configured to receive the fourth control signal; and the selecting of the different light emitting mode according to the different mode selecting signal by the mode selecting circuit comprises: applying the first control signal having a first level to the first switching device so that the first connection terminal of the first switching device is connected to one second connection terminal of the first switching device, applying the second control signal having a second level to the second switching device so that the first connection terminal of the second switching device is connected to one second connection terminal of the second switching device, applying the third control signal to the one first switching transistor so that the one first switching transistor is turned off, and applying the fourth control signal to the one second switching transistor so that the one second switching transistor is turned off; applying the first control signal having a third level to the first switching device so that the first connection terminal of the first switching device is connected to another second connection terminal of the first switching device, applying the second control signal having a fourth level to the second switching device so that the first connection terminal of the second switching device is connected to another second connection terminal of the second switching device, applying the third control signal to the one first switching transistor so that the one first switching transistor is turned off, and applying the fourth control signal to the one second switching transistor so that the one second switching transistor is turned off; applying the first control signal having the first level to the first switching device so that the first connection terminal of the first switching device is connected to the one second connection terminal of the first switching device, applying the second control signal having the fourth level to the second switching device so that the first connection terminal of the second switching device is connected to the another second connection terminal of the second switching device, applying the third control signal to the one first switching transistor so that the one first switching transistor is turned off, and applying the fourth control signal to the one second switching transistor so that the one second switching transistor is turned off; applying the first control signal having the third level to the first switching device so that the first connection terminal of the first switching device is connected to the another second connection terminal of the first switching device, applying the second control signal having the second level to the second switching device so that the first connection terminal of the second switching device is connected to the one second connection terminal of the second switching device, applying the third control signal to the one first switching transistor so that the one first switching transistor is turned off, and applying the fourth control signal to the one second switching transistor so that the one second switching transistor is turned off; or applying the first control signal to the first switching device so that the first connection terminal of the first switching device is connected to a second connection terminal of the first switching device, applying the second control signal to the second switching device so that the first connection terminal of the second switching device is connected to a second connection terminal of the second switching device, applying the third control signal to the one first switching transistor so that the one first switching transistor is turned on, and applying the fourth control signal to the one second switching transistor so that the one second switching transistor is turned on.

In some embodiments, the third control signal is the same as the fourth control signal.

In some embodiments, the first switching sub-circuit comprises a plurality of third switching transistors, the second switching sub-circuit comprises a plurality of fourth switching transistors, the mode selecting signal comprises a plurality of fifth control signals and a plurality of sixth control signals, a plurality of first electrodes of the plurality of third switching transistors are electrically connected to the plurality of first electrodes of the light emitting device in one-to-one correspondence, a plurality of second electrodes of the plurality of third switching transistors are electrically connected to the pixel driving circuit, a gate of each of the plurality of third switching transistors is configured to receive a fifth control signal corresponding to the each of the plurality of third switching transistors, a plurality of first electrodes of the plurality of fourth switching transistors are electrically connected to the plurality of second electrodes of the light emitting device in one-to-one correspondence, a plurality of second electrodes of the plurality of fourth switching transistors are electrically connected to a first voltage terminal, and a gate of each of the plurality of fourth switching transistors is configured to receive a sixth control signal corresponding to the each of the plurality of fourth switching transistors; and the selecting of the different light emitting mode according to the different mode selecting signal by the mode selecting circuit comprises: applying one fifth control signal having a low level to one third switching transistor of the plurality of third switching transistors so that the one third switching transistor is turned on, and applying another fifth control signal having a high level to another third switching transistor of the plurality of third switching transistors so that the another third switching transistor is turned off, applying one sixth control signal having a high level to one fourth switching transistor of the plurality of fourth switching transistors so that the one fourth switching transistor is turned off, and applying another sixth control signal having a low level to another fourth switching transistor of the plurality of fourth switching transistors so that the another fourth switching transistor is turned on; applying the one fifth control signal having a high level to the one third switching transistor of the plurality of third switching transistors so that the one third switching transistor is turned off, and applying the another fifth control signal having a low level to the another third switching transistor of the plurality of third switching transistors so that the another third switching transistor is turned on, applying the one sixth control signal having a low level to the one fourth switching transistor of the plurality of fourth switching transistors so that the one fourth switching transistor is turned on, and applying the another sixth control signal having a high level to the another fourth switching transistor of the plurality of fourth switching transistors so that the another fourth switching transistor is turned off; applying the one fifth control signal having the low level to the one third switching transistor of the plurality of third switching transistors so that the one third switching transistor is turned on, applying the another fifth control signal having the high level to the another third switching transistor of the plurality of third switching transistors so that the another third switching transistor is turned off, applying the one sixth control signal having the low level to the one fourth switching transistor of the plurality of fourth switching transistors so that the one fourth switching transistor is turned on, and applying the another sixth control signal having the high level to the another fourth switching transistor of the plurality of fourth switching transistors so that the another fourth switching transistor is turned off; applying the one fifth control signal having the high level to the one third switching transistor of the plurality of third switching transistors so that the one third switching transistor is turned off, applying the another fifth control signal having the low level to the another third switching transistor of the plurality of third switching transistors so that the another third switching transistor is turned on, applying the one sixth control signal having the high level to the one fourth switching transistor of the plurality of fourth switching transistors so that the one fourth switching transistor is turned off, and applying the another sixth control signal having the low level to the another fourth switching transistor of the plurality of fourth switching transistors so that the another fourth switching transistor is turned on; or applying the plurality of fifth control signals having the low level to the plurality of third switching transistors so that the plurality of third switching transistors are turned on, and applying the plurality of sixth control signals having the low level to the plurality of fourth switching transistors so that the plurality of fourth switching transistors are turned on.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate embodiments of the present disclosure and, together with this specification, serve to explain the principles of the present disclosure.

The present disclosure may be more clearly understood from the following detailed description with reference to the accompanying drawings, in which.

Figure 1:
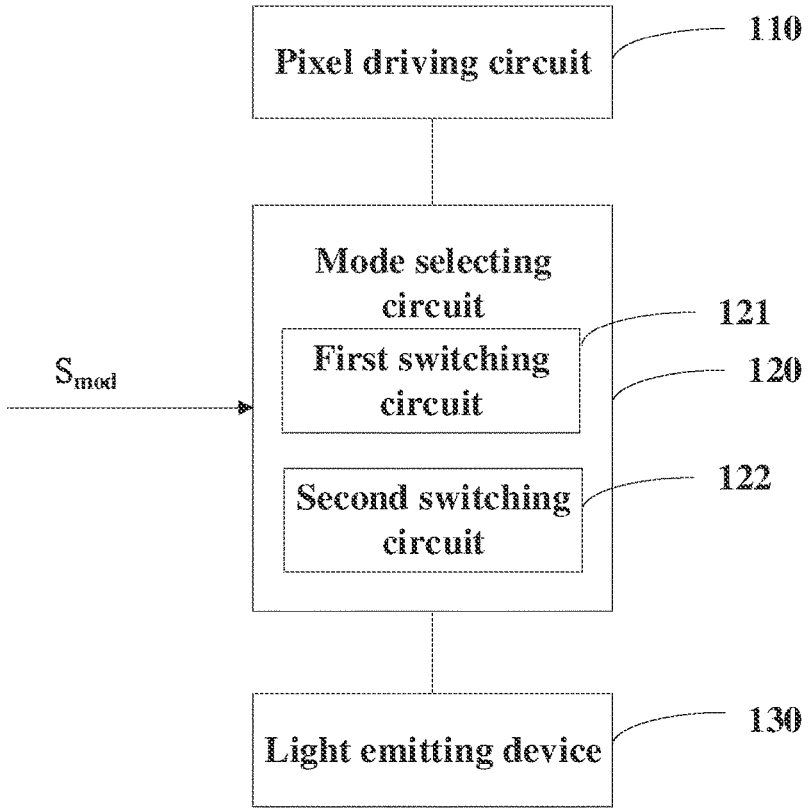
FIG. 1 is a structural view showing a pixel circuit according to an embodiment of the present disclosure.

It should be understood that the dimensions of the various parts shown in the accompanying drawings are not drawn according to the actual scale. In addition, the same or similar reference signs are used to denote the same or similar components.

DETAILED DESCRIPTION

Various exemplary embodiments of the present disclosure will now be described in detail in conjunction with the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include", or the like means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

All the terms (comprising technical and scientific terms) used in the present disclosure have the same meanings as understood by those skilled in the art of the present disclosure unless otherwise defined. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

In the related art, the organic material layer of the organic light emitting diode has a certain thickness. The inventors of the present disclosure have found that, since the organic material layer is formed by evaporation, it is difficult to control a uniform thickness of the organic material layer. The uneven thickness of the organic material layer may affect a uniform display. In addition, in the process of manufacturing thin film transistors for a display screen, these thin film transistors may also have a problem of unevenness, which may also affect a uniform display. During normal high grayscale display, since the brightness of the display is high, it is rather difficult for human eyes to find an uneven display phenomenon. However, during a low grayscale display, since the driving current for the display is relatively small, the uneven thickness of the organic material layer and the uneven thin film transistors may affect a uniform display. Therefore, in the related art, the OLED display device has a problem of uneven display.

In view of this, the embodiments of the present disclosure provide a pixel circuit to improve a uniform display of the display device. The pixel circuit according to some embodiments of the present disclosure will be described in detail below in conjunction with the accompanying drawings.

FIG. 1 is a structural view showing a pixel circuit according to an embodiment of the present disclosure. As shown in FIG. 1, the pixel circuit comprises a pixel driving circuit 110, a mode selecting circuit 120 and a light emitting device 130.

The pixel driving circuit 110 is configured to output a driving current. For example, the pixel driving circuit 110 is configured to output the driving current according to a data signal. For example, the driving current may be transmitted to the light emitting device 130 through the mode selecting circuit 120 so as to drive the light emitting device to emit light.

The mode selecting circuit 120 is configured to select a different light emitting mode according to a different mode selecting signal $S_{mod}$.

The light emitting device 130 is configured to emit light having a different brightness according to a different light emitting mode under the driving of the driving current output from the pixel driving circuit 110.

In some embodiments, the light emitting mode comprises a first light emitting mode, a second light emitting mode, and a third light emitting mode. A light emitting brightness of the light emitting device 130 in the first light emitting mode is less than a light emitting brightness of the light emitting device 130 in the second light emitting mode, and the light emitting brightness of the light emitting device 130 in the second light emitting mode is less than a light emitting brightness of the light emitting device 130 in the third light emitting mode, in a case where the pixel driving circuit 110 is input with the same grayscale data.

In some embodiments, the light emitting device comprises: a first electrode structure, a second electrode structure, and a functional layer between the first electrode structure and the second electrode structure. For example, the functional layer comprises a light emitting layer.

In some embodiments, as shown in FIG. 1, the mode selecting circuit comprises a first switching sub-circuit 121 and a second switching sub-circuit 122. The first switching sub-circuit 121 is electrically connected to the pixel driving circuit 110 and the first electrode structure. The first switching sub-circuit 121 is configured to perform a different first conduction mode in response to a different mode selecting signal. Here, the first conduction mode is a connection state when the first switching sub-circuit is turned on. The second switching sub-circuit 122 is electrically connected to a first voltage terminal and the second electrode structure (not shown in FIG. 1). The second switching sub-circuit 122 is configured to perform a different in response to a different mode selecting signal. Here, the second conduction mode is a connection state when the second switching sub-circuit is turned on. The mode selecting circuit 120 is configured to determine the light emitting mode according to the first conduction mode and the second conduction mode. For example, the mode selecting circuit determines a different light emitting mode under a different first conduction mode and a different second conduction mode.

So far, a pixel circuits according to some embodiments of the present disclosure is provided. In the pixel circuit, the pixel driving circuit outputs a driving current; the mode selecting circuit selects a different light emitting mode according to a different mode selecting signal; and the light emitting device emits light having a different brightness according to a different light emitting mode under the driving of the driving current. In this way, although there might be a problem of uneven thickness of the organic material layer and uneven thin film transistors in different pixel circuits of the display device, since different pixel circuits may emit light according to different light emitting modes, different pixel circuits may emit light having brightness as uniform as possible, so as to improve a uniform display of the display device. For example, the uniform display of low grayscale can be improved.

In some embodiments, a display panel comprises a plurality of pixel circuits. At least part of pixel circuits in the plurality of pixel circuits may receive the same mode selecting signal. For example, the pixel circuits in an area of a part of the display panel may receive the same mode selecting signal, or the plurality of pixel circuits of the display panel may receive the same mode selecting signal.

In some embodiments, at least one of the first electrode structure or the second electrode structure of the light emitting device comprises a plurality of electrodes spaced apart from each other. For example, the first electrode structure comprises a plurality of first electrodes spaced apart from each other. For example, the second electrode structure comprises a plurality of second electrodes spaced apart from each other.

Figure 2:
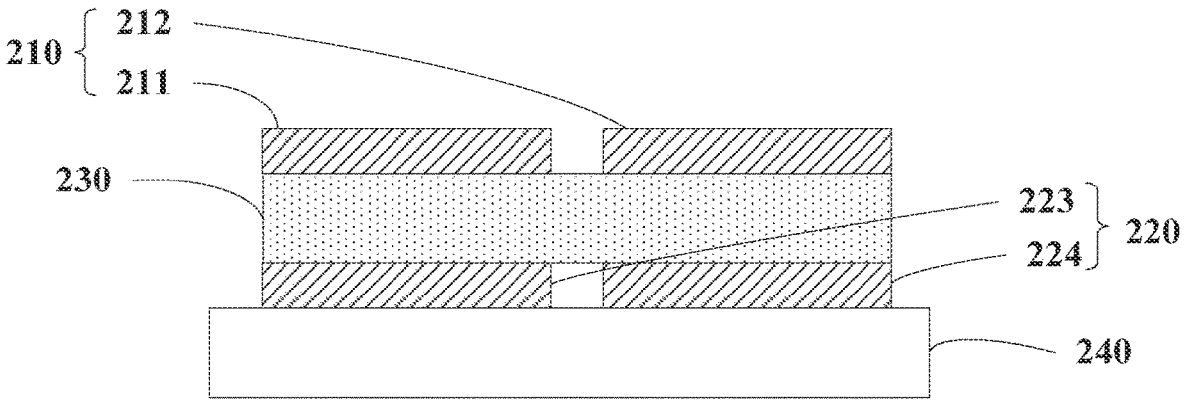
FIG. 2 is a cross-sectional view showing a light emitting device according to an embodiment of the present disclosure.

FIG. 2 is a cross-sectional view showing a light emitting device according to an embodiment of the present disclosure.

As shown in FIG. 2, the light emitting device comprises: a plurality of first electrodes 210 spaced apart from each other (as the first electrode structure), a plurality of second electrodes 220 spaced apart from each other (as the second electrode structure), and a functional layer 230 between the plurality of first electrodes 210 and the plurality of second electrodes 220. The functional layer 230 comprises a light emitting layer. For example, the functional layer may also comprise an electron transport layer, a hole transport layer, an electron blocking layer, a hole blocking layer, and the like.

As shown in FIG. 2, the light emitting device is on an initial structure layer 240. For example, the initial structure layer 240 comprises a substrate. For another example, the initial structure layer further comprises a structure layer for a thin film transistor on the substrate and the like. For another example, the initial structure layer further comprises an anode layer electrically connected to the thin film transistor and the like.

In some embodiments, as shown in FIG. 2, the plurality of first electrodes 210 comprises a first sub-electrode 211 and a second sub-electrode 212. The plurality of second electrodes 220 comprises a third sub-electrode 223 and a fourth sub-electrode 224. An orthographic projection of the first sub-electrode 211 on the initial structure layer 240 at least partially overlaps with an orthographic projection of the third sub-electrode 223 on the initial structure layer 240. An orthographic projection of the second sub-electrode 212 on the initial structure layer 240 at least partially overlaps with an orthographic projection of the fourth sub-electrode 224 on the initial structure layer 240. For example, the first electrode is a cathode, and the second electrode is an anode. Thus, FIG. 2 shows a light emitting device with dual cathodes and dual anodes. The dual cathodes and the dual anodes are uniformly distributed on the functional layer 230 respectively.

It should be noted that the first electrode structure of the light emitting device shown in FIG. 2 comprises two sub-electrodes, and the second electrode structure also comprises two sub-electrodes. However, the numbers of sub-electrodes comprised in the first electrode structure and the second electrode structure of the embodiments of the present disclosure respectively are not limited to this. For example, the first electrode structure and the second electrode structure may each comprise more than two sub-electrodes. For another example, one of the two electrode structures comprises one sub-electrode, and the other comprises two or more sub-electrodes.

In some embodiments, for different light emitting modes, a different first electrode and a different second electrode may be selected for transmitting the driving current, so that the light emitting layer of the light emitting device emits light. For different light emitting modes, an area where the light emitting device is driven to emit light is different.

For example, for the first light emitting mode, the first sub-electrode 211 and the fourth sub-electrode 224 may be selected for transmitting the driving current, or the second sub-electrode 212 and the third sub-electrode 223 may be selected for transmitting the driving current. For the second light emitting mode, the first sub-electrode 211 and the third sub-electrode 223 may be selected for transmitting the driving current, or the second sub-electrode 212 and the fourth sub-electrode 224 may be selected for transmitting the driving current. For the third light emitting mode, the first sub-electrode 211, the second sub-electrode 212, the third sub-electrode 223, and the fourth sub-electrode 224 may all be selected for transmitting the driving current.

In this case, the area where the light emitting device is driven to emit light in different light emitting modes may satisfy the following condition: $S1<S2<S3$, where S1 is an area where the light emitting device is driven to emit light in the first light emitting mode, S2 is an area where the light emitting device is driven to emit light in the second light emitting mode, and S3 is an area where the light emitting device is driven to emit light in the third light emitting mode. In this way, the light emitting brightness of the light emitting device in different light emitting modes may satisfy the following condition: $L1<L2<L3$, where L1 is a light emitting brightness of the light emitting device in the first light emitting mode, L2 is a light emitting brightness of the light emitting device in the second light emitting mode, and L3 is a light emitting brightness of the light emitting device in the third light emitting mode.

In the above-described embodiment, a different light emitting mode is selected so that the light emitting device may emit light according to a different light emitting area. For example, during a low grayscale display, the light emitting device may select a small light emitting area. In this case, the light emitting device may be driven using a large driving current, so as to emit light having a low brightness. In this way, it is beneficial to achieve precise control of the driving current and avoid a uniform display problem resulting from a low current during low grayscale display in the related art as much as possible.

Figure 3:
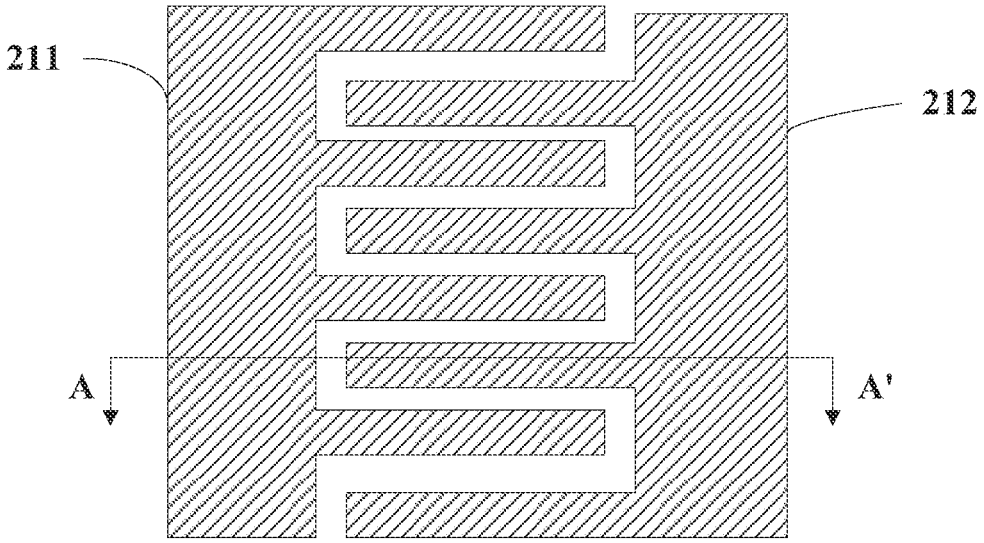
FIG. 3 is a top view showing a light emitting device according to an embodiment of the present disclosure.

FIG. 3 is a top view showing a light emitting device according to an embodiment of the present disclosure. The schematic cross-sectional view of the light emitting device shown in FIG. 2 may be a schematic cross-sectional view of the structure taken along the line A-A' in FIG. 3.

FIG. 3 shows exemplary shapes of the first sub-electrode 211 and the second sub-electrode 212. The first sub-electrode 211 and the second sub-electrode 212 each have portions that cross each other. For example, as shown in FIG. 3, the first sub-electrode 211 and the second sub-electrode 212 each have a comb-like structure, and comb teeth of the comb-like structure of the first sub-electrode 211 are arranged to cross comb teeth of the comb-like structure of the second sub-electrode 212. In this way, the first sub-electrode 211 and the second sub-electrode 212 may be more evenly distributed. In some embodiments, an area of the first sub-electrode is equal to an area of the second sub-electrode in a direction parallel to an extension direction of the functional layer. This facilitates the control of a light emitting area of the light emitting device.

In some embodiments, the third sub-electrode 223 may have the same shape as the first sub-electrode 211, and the fourth sub-electrode 224 may have the same shape as the second sub-electrode 212. For example, similar to the first sub-electrode 211 and the second sub-electrode 212 shown in FIG. 3, the third sub-electrode 223 and the fourth sub-electrode 224 each have a comb-like structure, and comb teeth of the comb-like structure of the third sub-electrode 223 are arranged to cross comb teeth of the comb-like structure of the fourth sub-electrode 224. In some embodiments, an area of the third sub-electrode is equal to an area of the fourth sub-electrode in the direction parallel to the extension direction of the functional layer. This facilitates the control of the light emitting area of the light emitting device.

It should be noted that the shape of each sub-electrode shown in FIG. 3 is only exemplary, and the scope of the embodiments of the present disclosure is not limited to this. For example, the shape of the sub-electrodes may also be round, square, or the like.

Figure 4:
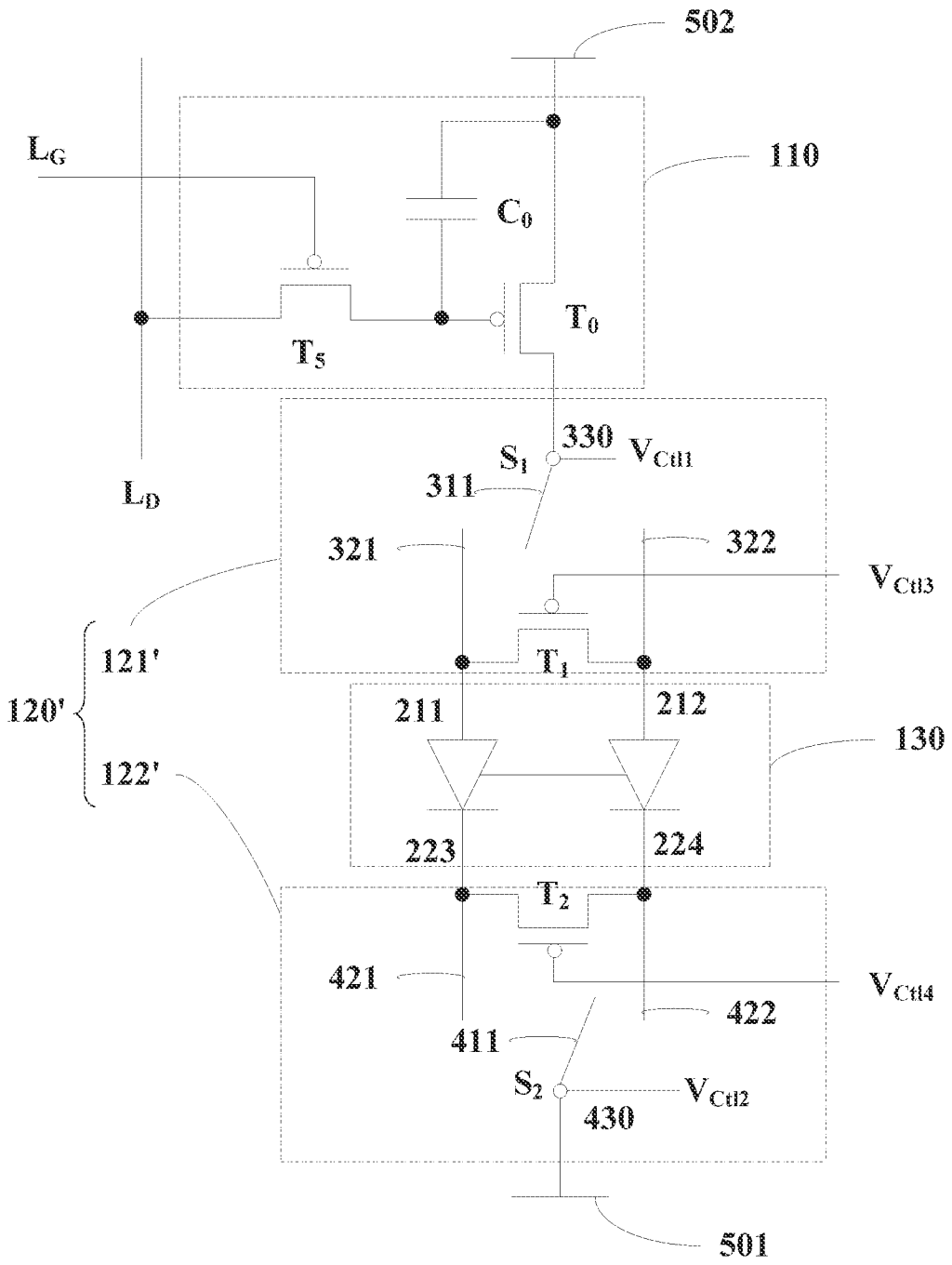
FIG. 4 is a structural view showing a pixel circuit according to another embodiment of the present disclosure.

FIG. 4 is a structural view showing a pixel circuit according to another embodiment of the present disclosure. For example, FIG. 4 shows specific circuit structures of the pixel driving circuit 110, the mode selecting circuit 120', and the light emitting device 130 according to some embodiments.

In some embodiments, as shown in FIG. 4, the mode selecting circuit 120' comprises a first switching sub-circuit 121' and a second switching sub-circuit 122'.

In some embodiments, as shown in FIG. 4, the first switching sub-circuit 121' comprises a first switching device $S_1$ and at least one first switching transistor $T_1$. The second switching sub-circuit 122' comprises a second switching device $S_2$ and at least one second switching transistor $T_2$. The mode selecting signal $S_{mod}$ comprises: a first control signal $V_{Ct11}$ for controlling the first switching device, a second control signal $V_{Ct12}$ for controlling the second switching device, a third control signal $V_{Ct13}$ for controlling the at least one first switching transistor $T_1$ and a fourth control signal $V_{Ct14}$ for controlling the at least one second switching transistor $T_2$.

In some embodiments, as shown in FIG. 4, the at least one first switching transistor $T_1$ comprises one first switching transistor. The at least one second switching transistor $T_2$ comprises one second switching transistor.

As shown in FIG. 4, a first connection terminal 311 of the first switching device $S_1$ is electrically connected to the pixel driving circuit 110. A plurality of second connection terminals of the first switching device $S_1$ are electrically connected to the plurality of first electrodes of the light emitting device 130 in one-to-one correspondence. For example, the plurality of second connection terminals of the first switching device $S_1$ comprises two second connection terminals 321 and 322. One second connection terminal 321 of the first switching device $S_1$ is electrically connected to the first sub-electrode 211 of the light emitting device, and the other second connection terminal 322 of the first switching device $S_1$ is electrically connected to the second sub-electrode 212 of the light emitting device. A control terminal 330 of the first switching device $S_1$ is configured to receive the first control signal $V_{Ct11}$. The first switching device $S_1$ is configured to connect the first connection terminal 311 of the first switching device to one of the plurality of second connection terminals of the first switching device in response to the first control signal $V_{Ct11}$. For example, the first switching device $S_1$ connects its first connection terminal 311 to its second connection terminal 321. For another example, the first switching device $S_1$ connects its first connection terminal 311 to its other second connection terminal 322.

In some embodiments, the first switching device $S_1$ comprises a PMOS (P-channel Metal Oxide Semiconductor) transistor (for example, referred to as a first PMOS transistor) and a NMOS (N-channel Metal Oxide Semiconductor, N-channel Metal Oxide Semiconductor) transistor (for example, referred to as a first NMOS transistor) electrically connected to the PMOS transistor. For example, a first electrode of the first PMOS transistor and a first electrode of the first NMOS transistor together serve as the first connection terminal 311 to be electrically connected to the pixel driving circuit. A second electrode (for example, as the second connection terminal 321) of the first PMOS transistor and a second electrode (for example, as the second connection terminal 322) of the first NMOS transistor are electrically connected to different first electrodes of the light emitting device respectively. A gate of the first PMOS transistor and a gate of the first NMOS transistor together serve as the control terminal 330 for receiving the first control signal $V_{Ct11}$. Of course, the first switching device $S_1$ is only exemplary, and the implementation of the first switching device $S_1$ adopted in the embodiments of the present disclosure is not limited to this.

In some embodiments, one first switching transistor is provided between any two adjacent first electrodes of the plurality of first electrodes of the light emitting device 130. A first electrode of the one first switching transistor is electrically connected to one first electrode of the any two adjacent first electrodes, and a second electrode of the one first switching transistor is electrically connected to the other first electrode of the any two adjacent first electrodes. For example, as shown in FIG. 4, one first switching transistor $T_1$ is provided between the first sub-electrode 211 and the second sub-electrode 212 of the light emitting device. A first electrode of the first switching transistor $T_1$ is electrically connected to the first sub-electrode 211 of the light emitting device, and a second electrode of the first switching transistor $T_1$ is electrically connected to the second sub-electrode 212 of the light emitting device. A gate of the first switching transistor $T_1$ is configured to receive the third control signal $V_{Ct13}$.

It should be noted that the light emitting device 130 shown in FIG. 4 has two first electrodes, so that one first switching transistor is provided between the two first electrodes. However, the embodiments of the present disclosure are not limited to this. For example, in the case where the light emitting device has more than two first electrodes (for example, three first electrodes), one first switching transistor may be provided between any two adjacent first electrodes, and each first switching transistor is controlled by a corresponding third control signal.

As shown in FIG. 4, a first connection terminal 411 of the second switching device $S_2$ is electrically connected to a first voltage terminal (for example, a common ground terminal) 501. The plurality of second connection terminals of the second switching device $S_2$ are electrically connected to the plurality of second electrodes of the light emitting device 130 in one-to-one correspondence. For example, the plurality of second connection terminals of the second switching device $S_2$ comprises two second connection terminals 421 and 422. One second connection terminal 421 of the second switching device $S_2$ is electrically connected to the third sub-electrode 223 of the light emitting device, and the other second connection terminal 422 of the second switching device $S_2$ is electrically connected to the fourth sub-electrode 224 of the light emitting device. A control terminal 430 of the second switching device $S_2$ is configured to receive the second control signal $V_{Ct12}$. The second switching device $S_2$ is configured to connect the first connection terminal 411 of the second switching device to one of the plurality of second connection terminals of the second switching device in response to the second control signal $V_{Ct12}$. For example, the second switching device $S_2$ connects its first connection terminal 411 to its second connection terminal 421. For another example, the second switching device $S_2$ connects its first connection terminal 411 to its other second connection terminal 422.

In some embodiments, the second switching device $S_2$ comprises a PMOS transistor (for example, referred to as a second PMOS transistor) and an NMOS transistor (for example, referred to as a second NMOS transistor) electrically connected to the PMOS transistor. For example, a first electrode of the second PMOS transistor and a first electrode of the second NMOS transistor together serve as the first connection terminal 411 to be electrically connected to the first voltage terminal. A second electrode (for example, as the second connection terminal 421) of the second PMOS transistor and a second electrode (for example, as the second connection terminal 422) of the second NMOS transistor are electrically connected to different second electrodes of the light emitting device respectively. A gate of the second PMOS transistor and a gate of the second NMOS transistor together serve as the control terminal 430 for receiving the second control signal $V_{Ct12}$. Of course, the second switching device $S_2$ is only exemplary, and the implementation of the second switching device $S_2$ adopted in the embodiments of the present disclosure is not limited to this.

In some embodiments, one second switching transistor is provided between any two adjacent second electrodes of the plurality of second electrodes of the light emitting device 130. A first electrode of the one second switching transistor is electrically connected to one second electrode of the any two adjacent second electrodes, and a second electrode of the one second switching transistor is electrically connected to the other second electrode of the any two adjacent second electrodes. As shown in FIG. 4, one second switching transistor $T_2$ is provided between the third sub-electrode 223 and the fourth sub-electrode 224 of the light emitting device. A first electrode of the second switching transistor $T_2$ is electrically connected to the third sub-electrode 223 of the light emitting device, and a second electrode of the second switching transistor $T_2$ is electrically connected to the fourth sub-electrode 224 of the light emitting device. A gate of the second switching transistor $T_2$ is configured to receive the fourth control signal $V_{Ct14}$.

It should be noted that the light emitting device 130 shown in FIG. 4 has two second electrodes, so that one second switching transistor is provided between the two second electrodes. However, the embodiments of the present disclosure are not limited to this. For example, in a case where the light emitting device has more than two second electrodes (for example, three second electrodes), one second switching transistor may be provided between any two adjacent second electrodes, and each second switching transistor is controlled by a corresponding fourth control signal.

In some embodiments, a conductivity type of the first switching transistor $T_1$ is the same as a conductivity type of the second switching transistor $T_2$. For example, the first switching transistor $T_1$ and the second switching transistor $T_2$ are both PMOS transistors or both NMOS transistors. In this case, the third control signal $V_{Ct13}$ may be the same as the fourth control signal $V_{Ct14}$. This may reduce the number of control signals.

In some embodiments, the pixel driving circuit 110 comprises a fifth switching transistor $T_5$, a capacitor $C_0$, and a driving transistor $T_0$. A first electrode of the fifth switching transistor $T_5$ is electrically connected to a data signal line $L_D$. A second electrode of the fifth switching transistor $T_5$ is electrically connected to a gate of the driving transistor $T_0$. A gate of the fifth switching transistor $T_5$ is electrically connected to a gate control line $L_G$. A first terminal of the capacitor $C_0$ is electrically connected to the gate of the driving transistor $T_0$. A second terminal of the capacitor $C_0$ is electrically connected to a second voltage terminal 502. A voltage of the second voltage terminal 502 is different from a voltage of the first voltage terminal 501. For example, the second voltage terminal 502 is a power supply voltage terminal. A first electrode of the driving transistor $T_0$ is electrically connected to the second voltage terminal 502. A second electrode of the driving transistor $T_0$ is electrically connected to the mode selecting circuit 120'. For example, the second electrode of the driving transistor $T_0$ is electrically connected to the first connection terminal 311 of the first switching device $S_1$.

It should be noted that the circuit structure of the pixel driving circuit shown in FIG. 4 is only exemplary, and the embodiments of the present disclosure may also adopt pixel driving circuits with other circuit structures. Therefore, the scope of the embodiments of the present disclosure is not limited to this.

The working process of the pixel circuit according to some embodiments of the present disclosure will be described in detail below in conjunction with FIG. 4.

In some embodiments, the first connection terminal 311 of the first switching device $S_1$ is connected to one second connection terminal 321 under the control of the first control signal $V_{Ct11}$ having a first level, and the first connection terminal 411 of the second switching device $S_2$ is connected to one second connection terminal 421 under the control of the second control signal $V_{Ct12}$ having a second level. In this way, the first switching sub-circuit 121' performs the first conduction mode having a first connection state, and the second switching sub-circuit 122' performs the second conduction mode having a first connection state. The driving current output by the pixel driving circuit 110 flows through the first sub-electrode 211, the functional layer, and the third sub-electrode 223 of the light emitting device 130, so that the light emitting device 130 emits light having a medium brightness L2 in the second light emitting mode.

In other embodiments, the first connection terminal 311 of the first switching device S1 is connected to another second connection terminal 322 under the control of the first control signal $V_{Ct11}$ having a third level, and the first connection terminal 411 of the second switching device $S_2$ is connected to another second connection terminal 422 under the control of the second control signal $V_{Ct12}$ having a fourth level. Here, the third level is different from the first level, and the fourth level is different from the second level. In this way, the first switching sub-circuit 121' performs the first conduction mode having a second connection state, and the second switching sub-circuit 122' performs the second conduction mode having a second connection state. The driving current output by the pixel driving circuit 110 flows through the second sub-electrode 212, the functional layer and the fourth sub-electrode 224 of the light emitting device 130, so that the light emitting device 130 emits light having the medium brightness L2 in the second light emitting mode.

In other embodiments, the first connection terminal 311 of the first switching device $S_1$ is connected to the one second connection terminal 321 under the control of the first control signal $V_{Ct11}$ having the first level, and the first connection terminal 411 of the second switching device $S_2$ is connected to the another second connection terminal 422 under the control of the second control signal $V_{Ct12}$ having the fourth level. In this way, the first switching sub-circuit 121' performs the first conduction mode having the first connection state, and the second switching sub-circuit 122' performs the second conduction mode having the second connection state. The driving current output by the pixel driving circuit 110 flows through the first sub-electrode 211, the functional layer and the fourth sub-electrode 224 of the light emitting device 130, so that the light emitting device 130 emits light having a low brightness L1 in the first light emitting mode.

In other embodiments, the first connection terminal 311 of the first switching device $S_1$ is connected to the another second connection terminal 322 under the control of the first control signal $V_{Ct11}$ having the third level, and the first connection terminal 411 of the second switching device $S_2$ is connected to the one second connection terminal 421 under the control of the second control signal $V_{Ct12}$ having the second level. In this way, the first switching sub-circuit 121' performs the first conduction mode having the second connection state, and the second switching sub-circuit 122' performs the second conduction mode having the first connection state. The driving current output by the pixel driving circuit 110 flows through the second sub-electrode 212, the functional layer, and the third sub-electrode 223 of the light emitting device 130, so that the light emitting device 130 emits light having the low brightness L1 in the first light emitting mode.

It should be noted that in the above-described four cases, the first switching transistor $T_1$ is turned off under the control of the third control signal $V_{Ct13}$, and the second switching transistor $T_2$ is turned off under the control of the fourth control signal $V_{Ct14}$. For example, the first switching transistor $T_1$ is turned off under the control of the third control signal $V_{Ct13}$ having a high level in the case where the first switching transistor $T_1$ is a PMOS transistor. Of course, those skilled in the art may understand that the first switching transistor $T_1$ may also be an NMOS transistor. For another example, the second switching transistor $T_2$ is turned off under the control of the fourth control signal $V_{Ct14}$ having a high level in the case where the second switching transistor $T_2$ is a PMOS transistor. Of course, those skilled in the art may understand that the second switching transistor $T_2$ may also be an NMOS transistor.

In other embodiments, the first connection terminal 311 of the first switching device $S_1$ is connected to the second connection terminal 321 or 322 under the control of the first control signal $V_{Ct11}$, and the first connection terminal 411 of the second switching device $S_2$ is connected to the second connection terminal 421 or 422 under the control of the second control signal $V_{Ct12}$. The first switching transistor $T_1$ is turned on under the control of the third control signal $V_{Ct13}$ (for example, the third control signal having a low level), and the second switching transistor $T_2$ is turned on under the control of the fourth control signal $V_{Ct14}$ (for example, the fourth control signal having a low level). The driving current output by the pixel driving circuit 110 flows through the first sub-electrode 211, the second sub-electrode 212, the functional layer, the third sub-electrode 223 and the fourth sub-electrode 224 of the light emitting device 130, so that the light emitting device 130 emits light having a high brightness L3 in the third light emitting mode.

So far, the above-described pixel circuit may emit light having different brightness according to different light emitting modes. In this way, even at a low grayscale, it is also possible that the driving current is not too small, which is beneficial to the precise control of the driving current, and avoid a uniform display problem caused by a low current during a low grayscale display in the related art as much as possible.

Figure 5:
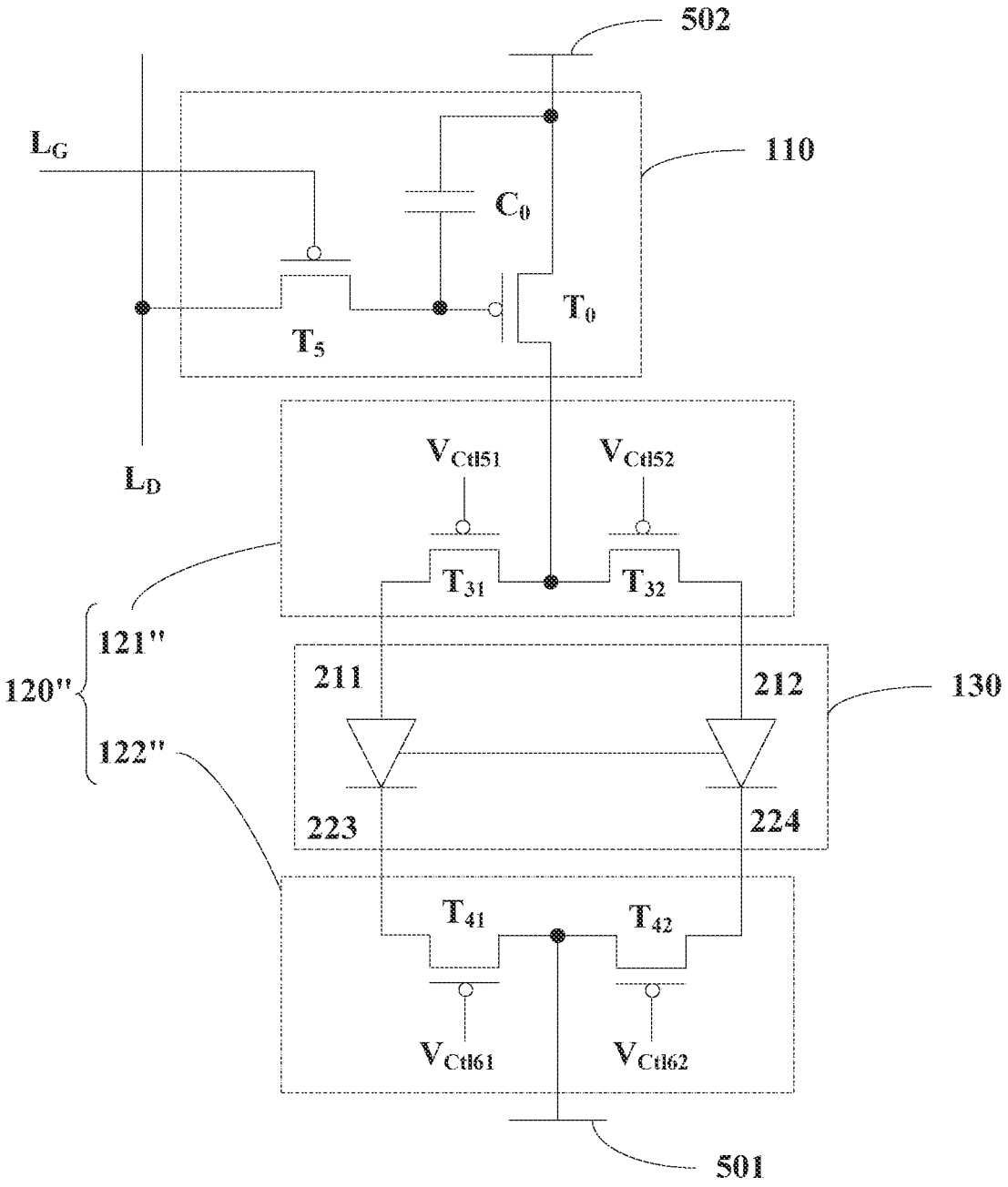
FIG. 5 is a structural view showing a pixel circuit according to another embodiment of the present disclosure.

FIG. 5 is a structural view showing a pixel circuit according to another embodiment of the present disclosure. For example, FIG. 5 shows specific circuit structures of the pixel driving circuit 110, the mode selecting circuit 120" and the light emitting device 130 according to some embodiments. Here, the circuit structure of the pixel driving circuit 110 has been described in detail above, and will not be described in detail here.

In some embodiments, as shown in FIG. 5, the mode selecting circuit 120" comprises a first switching sub-circuit 121" and a second switching sub-circuit 122".

In some embodiments, the first switching sub-circuit 121" comprises a plurality of third switching transistors. For example, the plurality of third switching transistors comprises two third switching transistors $T_{31}$ and $T_{32}$. In some embodiments, the second switching sub-circuit 122" comprises a plurality of fourth switching transistors. For example, the plurality of fourth switching transistors comprises two fourth switching transistors $T_{41}$ and $T_{42}$. In some embodiments, the third switching transistor is a PMOS transistor or an NMOS transistor, and the fourth switching transistor is a PMOS transistor or an NMOS transistor.

In some embodiments, the mode selecting signal $S_{mod}$ comprises a plurality of fifth control signals and a plurality of sixth control signals. For example, FIG. 5 shows a fifth control signal $V_{Ct151}$ for controlling one third switching transistor $T_{31}$ and a fifth control signal $V_{Ct152}$ for controlling another third switching transistor $T_{32}$, and FIG. 5 also shows a sixth control signal $V_{Ct161}$ for controlling one fourth switching transistor $T_{41}$ and a sixth control signal $V_{Ct162}$ for controlling another fourth switching transistor $T_{42}$.

In some embodiments, a plurality of first electrodes of the plurality of third switching transistors are electrically connected to the plurality of first electrodes of the light emitting device 130 in one-to-one correspondence. For example, as shown in FIG. 5, in the two third switching transistors, a first electrode of one third switching transistor $T_{31}$ is electrically connected to the first sub-electrode 211 of the light emitting device 130, and a first electrode of the other third switching transistor $T_{32}$ is electrically connected to the second sub-electrode 212 of the light emitting device 130. A plurality of second electrodes of the plurality of third switching transistors are electrically connected to the pixel driving circuit 110. For example, as shown in FIG. 5, the second electrodes of the two third switching transistors $T_{31}$ and $T_{32}$ are both electrically connected to the driving transistor $T_0$ of the pixel driving circuit 110. A gate of each third switching transistor is configured to receive a fifth control signal corresponding to the each third switching transistor. For example, as shown in FIG. 5, a gate of the one third switching transistor $T_{31}$ is configured to receive one fifth control signal $V_{Ct151}$, and a gate of the other third switching transistor $T_{32}$ is configured to receive another fifth control signal $V_{Ct152}$.

In some embodiments, a plurality of first electrodes of the plurality of fourth switching transistors are electrically connected to the plurality of second electrodes of the light emitting device 130 in one-to-one correspondence. For example, as shown in FIG. 5, in the two fourth switching transistors, a first electrode of one fourth switching transistor $T_{41}$ is electrically connected to the third sub-electrode 223 of the light emitting device 130, and a first electrode of the other fourth switching transistor $T_{42}$ is electrically connected to the fourth sub-electrode 224 of the light emitting device 130. A plurality of second electrodes of the plurality of fourth switching transistors are electrically connected to a first voltage terminal 501. For example, as shown in FIG. 5, the second electrodes of the two fourth switching transistors $T_{41}$ and $T_{42}$ are electrically connected to the first voltage terminal (for example, a common ground terminal) 501. A gate of each fourth switching transistor is configured to receive a sixth control signal corresponding to the each fourth switching transistor. For example, as shown in FIG. 5, a gate of the one fourth switching transistor $T_{41}$ is configured to receive one sixth control signal $V_{Ct161}$, and a gate of the other fourth switching transistor $T_{42}$ is configured to receive another sixth control signal $V_{Ct162}$.

So far, the structure of the pixel circuit according to other embodiments of the present disclosure is provided. In the pixel circuit, the first switching sub-circuit is controlled by a plurality of fifth control signals, and the second switching sub-circuit is controlled by a plurality of sixth control signals. Under the control of the fifth control signals and the sixth control signals, the pixel circuit may emit light having different brightness according to different light emitting modes. In this way, for a display device comprising a plurality of pixel circuits, the light emitting brightness of different pixel circuits in the plurality of pixel circuits may be made as uniform as possible, thereby improving a uniform display of the display device, especially during a low grayscale display.

Figure 6A:
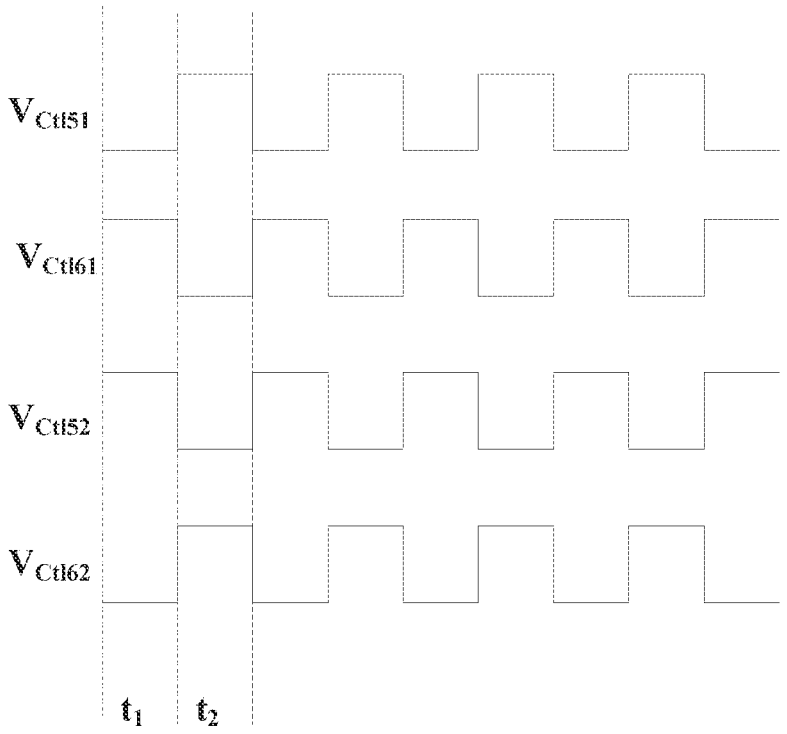
FIG. 6A is a timing diagram showing control signals for a pixel circuit according to an embodiment of the present disclosure.

FIG. 6A is a timing diagram showing control signals for a pixel circuit according to an embodiment of the present disclosure. FIG. 6A shows a timing diagram of a plurality of fifth control signals and a plurality of sixth control signals for the pixel circuit in the first light emitting mode. The working process of the pixel circuit under the control of the plurality of fifth control signals and the plurality of sixth control signals according to the first light emitting mode will be described in detail below in conjunction with FIGS. 5 and 6A. Here, the third switching transistor and the fourth switching transistor are both PMOS transistors as an example for description.

In some embodiments, as shown in FIGS. 5 and 6A, in a first stage $t_1$, one third switching transistor $T_{31}$ is turned on under the control of one fifth control signal $V_{Ct151}$ having a low level; another third switching transistor $T_{32}$ is turned off under the control of another fifth control signal $V_{Ct152}$ having a high level; one fourth switching transistor $T_{41}$ is turned off under the control of one sixth control signal $V_{Ct161}$ having a high level; another fourth switching transistor $T_{42}$ is turned on under the control of another sixth control signal $V_{Ct162}$ having a low level. Since the one third switching transistor $T_{31}$ is electrically connected to the first sub-electrode 211 of the light emitting device 130 and the another fourth switching transistor $T_{42}$ is electrically connected to the fourth sub-electrode 224 of the light emitting device 130, the driving current output by the pixel driving circuit 110 flows through the first sub-electrode 211, the functional layer and the fourth sub-electrode 224 of the light emitting device 130, so that the light emitting device 130 emits light having a low brightness L1 in the first light emitting mode.

In other embodiments, as shown in FIG. 5 and FIG. 6A, in a second stage $t_2$, the one third switching transistor $T_{31}$ is turned off under the control of the one fifth control signal $V_{Ct151}$ having a high level; the another third switching transistor $T_{32}$ is turned on under the control of the another fifth control signal $V_{Ct152}$ having a low level; the one fourth switching transistor $T_{41}$ is turned on under the control of the one sixth control signal $V_{Ct161}$ having a low level; the another fourth switching transistor $T_{42}$ is turned off under the control of the another sixth control signal $V_{Ct162}$ having a high level. Since the another third switching transistor $T_{32}$ is electrically connected to the second sub-electrode 212 of the light emitting device 130 and the one fourth switching transistor $T_{41}$ is electrically connected to the third sub-electrode 223 of the light emitting device 130, the driving current output by the pixel driving circuit 110 flows through the second sub-electrode 212, the functional layer and the third sub-electrode 223 of the light emitting device 130, so that the light emitting device 130 emits light having the low brightness L1 in the first light emitting mode.

So far, the working process of the pixel circuit shown in FIG. 5 to emit light according to the first light emitting mode has been described in detail.

Figure 6B:
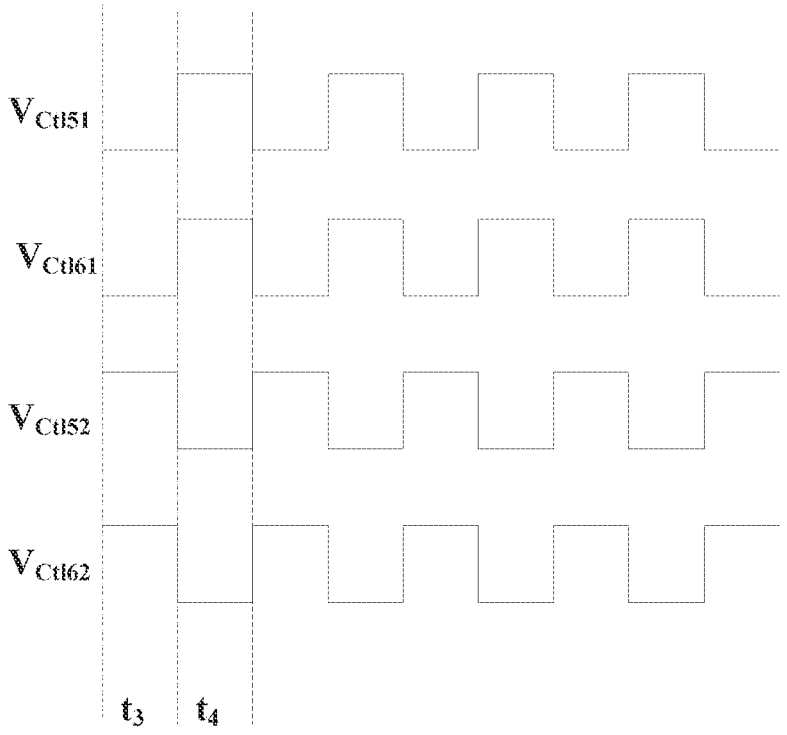
FIG. 6B is a timing diagram showing control signals for a pixel circuit according to another embodiment of the present disclosure.

FIG. 6B is a timing diagram showing control signals for a pixel circuit according to another embodiment of the present disclosure. FIG. 6B shows a timing diagram of a plurality of fifth control signals and a plurality of sixth control signals for the pixel circuit in the second light emitting mode. The working process of the pixel circuit under the control of the plurality of fifth control signals and the plurality of sixth control signals according to the second light emitting mode will be described in detail below in conjunction with FIGS. 5 and 6B. Here, the third switching transistor and the fourth switching transistor are both PMOS transistors as an example for description.

In some embodiments, as shown in FIGS. 5 and 6B, in a third stage $t_3$, the one third switching transistor $T_{31}$ is turned on under the control of the one fifth control signal $V_{Ct151}$ having the low level; the another third switching transistor $T_{32}$ is turned off under the control of the another fifth control signal $V_{Ct152}$ having the high level; the one fourth switching transistor $T_{41}$ is turned on under the control of the one sixth control signal $V_{Ct161}$ having the low level; the another fourth switching transistor $T_{42}$ is turned off under the control of the another sixth control signal $V_{Ct162}$ having the high level. In this case, the driving current output by the pixel driving circuit 110 flows through the first sub-electrode 211, the functional layer, and the third sub-electrode 223 of the light emitting device 130, so that the light emitting device 130 emits light having a medium brightness L2 in the second light emitting mode.

In other embodiments, as shown in FIGS. 5 and 6B, in a fourth stage $t_4$, the one third switching transistor $T_{31}$ is turned off under the control of the one fifth control signal $V_{Ct151}$ having the high level; the another third switching transistor $T_{32}$ is turned on under the control of the another fifth control signal $V_{Ct152}$ having the low level; the one fourth switching transistor $T_{41}$ is turned off under the control of the one sixth control signal $V_{Ct161}$ having the high level; the another fourth switching transistor $T_{42}$ is turned on under the control of the another sixth control signal $V_{Ct162}$ having the low level. In this case, the driving current output by the pixel driving circuit 110 flows through the second sub-electrode 212, the functional layer, and the fourth sub-electrode 224 of the light emitting device 130, so that the light emitting device 130 emits light having the medium brightness L2 in the second light emitting mode.

So far, the working process of the pixel circuit shown in FIG. 5 to emit light according to the second light emitting mode has been described in detail.

Figure 6C:
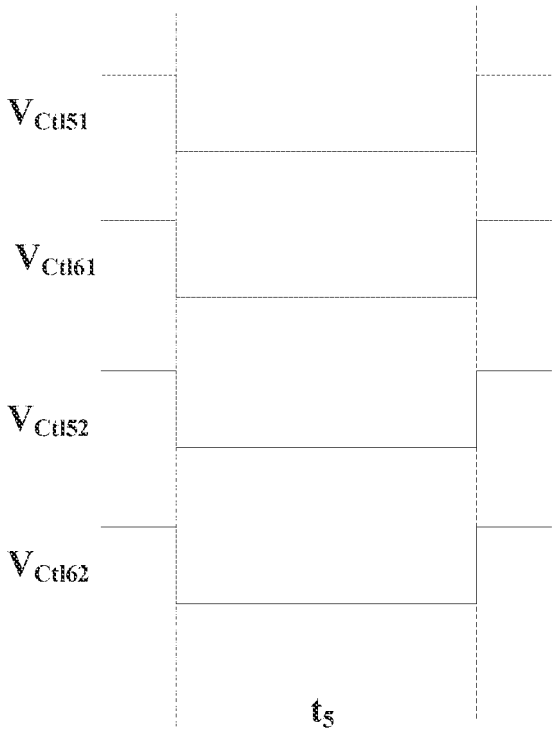
FIG. 6C is a timing diagram showing control signals for a pixel circuit according to another embodiment of the present disclosure.

FIG. 6C is a timing diagram showing control signals for a pixel circuit according to another embodiment of the present disclosure. FIG. 6C shows a timing diagram of the plurality of fifth control signals and the plurality of sixth control signals for the pixel circuit in the third light emitting mode. The working process of the pixel circuit under the control of the plurality of fifth control signals and the plurality of sixth control signals according to the third light emitting mode will be described in detail below in conjunction with FIGS. 5 and 6C. Here, the third switching transistor and the fourth switching transistor are both PMOS transistors as an example for description.

In some embodiments, as shown in FIGS. 5 and 6C, in a fifth stage $t_5$, the fifth control signals $V_{Ct151}$ and $V_{Ct152}$, and the sixth control signals $V_{Ct161}$ and $V_{Ct162}$ are all signals having a low level. The third switching transistors $T_{31}$ and $T_{32}$ and the fourth switching transistors $T_{41}$ and $T_{42}$ are all turned on under the control of these signals. Therefore, the driving current output by the pixel driving circuit 110 flows through the first sub-electrode 211, the second sub-electrode 212, the functional layer, the third sub-electrode 223, and the fourth sub-electrode 224 of the light emitting device 130, so that the light emitting device 130 emits light having a high brightness L3 in the third light emitting mode.

So far, the working process of the pixel circuit shown in FIG. 5 to emit light according to the third light emitting mode has been described in detail.

In some embodiments of the present disclosure, the control signals (for example, the first control signal, the second control signal, the third control signal, the fourth control signal, the fifth control signal, and the sixth control signal) used may be uniformly controlled by a timing controller. The timing controller controls the mode selecting circuit to select a required light emitting mode after analyzing the grayscale data required to be displayed.

In the related art, since a light emitting material of the OLED (as a light emitting device) comprises an organic material, in the case where the OLED is driven to emit light for a long time by the driving current, the organic material may attenuate rapidly, thereby resulting in a lowered brightness and a reduced service life of the OLED. However, by implementing intermittently driving the light emitting device according to the above-described control signal of the embodiments of the present disclosure, it is possible to slow down the attenuation speed of the light emitting device and prolong the service life.

In addition, in the related art, due to the drift in a threshold voltage of the driving transistor and different attenuation rates of the organic material of different RGB (red, green, blue) sub-pixels (each sub-pixel comprises a pixel circuit), different pixel circuits are likely to have a problem of inconsistent brightness after use for a period of time. When the display device displays an image for a long time, since the driving currents of the pixel circuits are different when displaying different parts of the image, and the attenuation rates of different OLEDs are also different, the problem of uneven display or image retention may occur. The pixel circuit of the embodiments of the present disclosure may slow down the attenuation speed of the light emitting device, thereby reducing the inconsistency in the attenuations of the light emitting materials of sub-pixels having different colors, thereby improving the display effect of the display device.

In some embodiments of the present disclosure, a display device is also provided. The display device comprises a plurality of pixel circuits as described above (for example, the pixel circuit shown in FIG. 1, 4, or 5). For example, the display device may be any product or component with a display function, such as a display panel, a display screen, a display, a mobile phone, a tablet computer, a notebook computer, a television, or a navigator.

Figure 8:
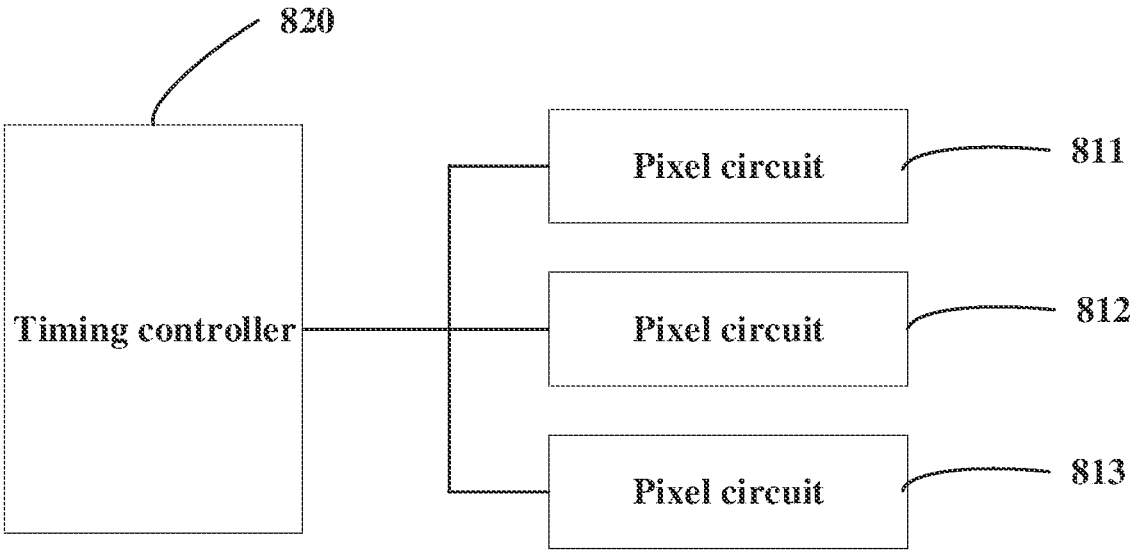
FIG. 8 is a structural view showing a display device according to an embodiment of the present disclosure.

FIG. 8 is a structural view showing a display device according to an embodiment of the present disclosure. As shown in FIG. 8, the display device comprises a plurality of pixel circuits 811, 812, and 813.

In some embodiments, as shown in FIG. 8, the display device further comprises a timing controller 820. The timing controller 820 is configured to provide mode selecting signals to the plurality of pixel circuits in one-to-one correspondence.

Figure 7:
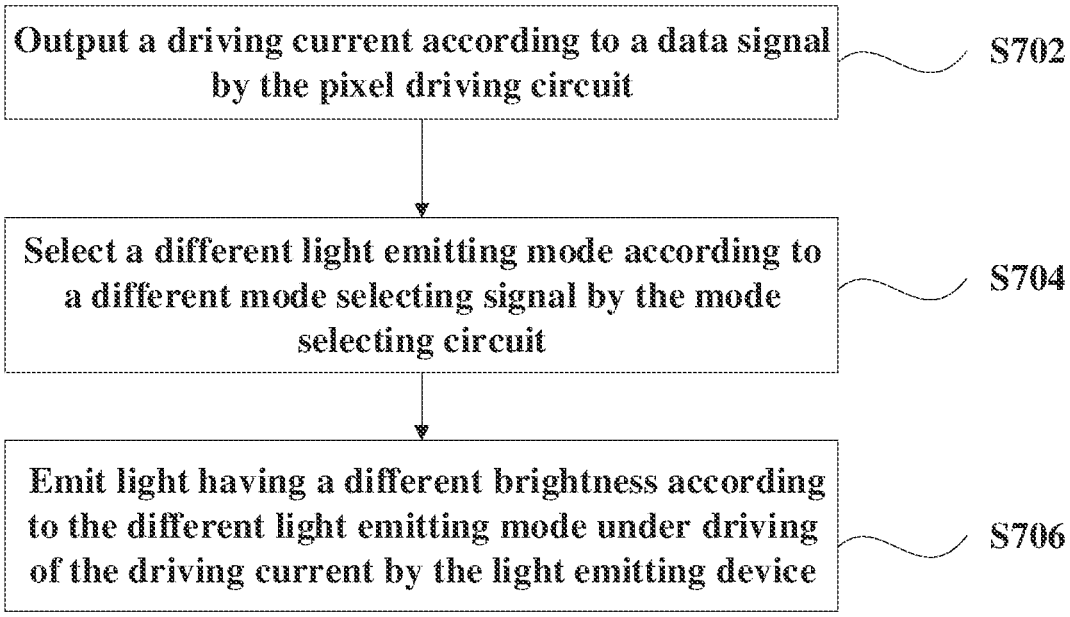
FIG. 7 is a flow chart showing a control method for a pixel circuit according to an embodiment of the present disclosure.

FIG. 7 is a flow chart showing a control method for a pixel circuit according to an embodiment of the present disclosure. The pixel circuit comprises a pixel driving circuit, a mode selecting circuit, and a light emitting device. As shown in FIG. 7, the control method comprises steps S702 to S706.

At step S702, a driving current is output according to a data signal by the pixel driving circuit.

At step S704, a different light emitting mode is selected according to a different mode selecting signal by the mode selecting circuit.

At step S706, light having a different brightness is emitted according to the different light emitting mode under driving of the driving current by the light emitting device.

In some embodiments, the light emitting mode comprises a first light emitting mode, a second light emitting mode, and a third light emitting mode. A light emitting brightness of the light emitting device in the first light emitting mode is less than a light emitting brightness of the light emitting device in the second light emitting mode, and the light emitting brightness of the light emitting device in the second light emitting mode is less than a light emitting brightness of the light emitting device in the third light emitting mode, in a case where the pixel driving circuit is input with the same grayscale data.

So far, a control method for a pixel circuit according to some embodiments of the present disclosure is provided. In this control method, the pixel driving circuit outputs a driving current according to a data signal, the mode selecting circuit selects a different light emitting mode according to a different mode selecting signal, and the light emitting device emits light having a different brightness according to a different light emitting mode under driving of the driving current. In this way, although there might be a problem of uneven thickness of the organic material layer and uneven thin film transistors in different pixel circuits of the display device, since different pixel circuits may emit light according to different light emitting modes, different pixel circuits may emit light having brightness as uniform as possible, so as to improve a uniform display of the display device. For example, the uniformity of the display device during a low grayscale display may be improved.

In some embodiments, the light emitting device comprises: a plurality of first electrodes spaced apart from each other, a plurality of second electrodes spaced apart from each other, and a functional layer between the plurality of first electrodes and the plurality of second electrodes. The functional layer comprises a light emitting layer. The light emitting device is on an initial structure layer.

For example, the plurality of first electrodes comprises a first sub-electrode and a second sub-electrode, and the plurality of second electrodes comprises a third sub-electrode and a fourth sub-electrode. An orthographic projection of the first sub-electrode on the initial structure layer at least partially overlaps with an orthographic projection of the third sub-electrode on the initial structure layer. An orthographic projection of the second sub-electrode on the initial structure layer at least partially overlaps with an orthographic projection of the fourth sub-electrode on the initial structure layer.

In some embodiments, the step S704 comprises: the mode selecting circuit controls the driving current to flow through the first sub-electrode, the functional layer and the fourth sub-electrode, or controls the driving current to flow through the second sub-electrode, the functional layer and the third sub-electrode, in response to a mode selecting signal corresponding to the first light emitting mode.

In other embodiments, the step S704 comprises: the mode selecting circuit controls the driving current to flow through the first sub-electrode, the functional layer and the third sub-electrode, or controls the driving current to flow through the second sub-electrode, the functional layer and the fourth sub-electrode, in response to a mode selecting signal corresponding to the second light emitting mode.

In other embodiments, the step S704 comprises: the mode selecting circuit controls the driving current to flow through the first sub-electrode, the second sub-electrode, the functional layer, the third sub-electrode and the fourth sub-electrode, in response to a mode selecting signal corresponding to the third light emitting mode.

In some embodiments, the first switching sub-circuit comprises a first switching device and at least one first switching transistor, and the second switching sub-circuit comprises a second switching device and at least one second switching transistor. The mode selecting signal comprises a first control signal for controlling the first switching device, a second control signal for controlling the second switching device, a third control signal for controlling the at least one first switching transistor, and a fourth control signal for controlling the at least one second switching transistor. A first connection terminal of the first switching device is electrically connected to the pixel driving circuit, a plurality of second connection terminals of the first switching device are electrically connected to the plurality of first electrodes of the light emitting device in one-to-one correspondence, and the first switching device is configured to connect the first connection terminal of the first switching device to one of the plurality of second connection terminals of the first switching device in response to the first control signal. One first switching transistor is provided between any two adjacent first electrodes of the plurality of first electrodes. A first electrode of the one first switching transistor is electrically connected to one first electrode of the any two adjacent first electrodes, a second electrode of the one first switching transistor is electrically connected to another first electrode of the any two adjacent first electrodes, and a gate of the one first switching transistor is configured to receive the third control signal. A first connection terminal of the second switching device is electrically connected to a first voltage terminal, a plurality of second connection terminals of the second switching device are electrically connected to the plurality of second electrodes of the light emitting device in one-to-one correspondence, and the second switching device is configured to connect the first connection terminal of the second switching device to one of the plurality of second connection terminals of the second switching device in response to the second control signal. One second switching transistor is provided between any two adjacent second electrodes of the plurality of second electrodes. A first electrode of the one second switching transistor is electrically connected to one second electrode of the any two adjacent second electrodes, a second electrode of the one second switching transistor is electrically connected to another second electrode of the any two adjacent second electrodes, and a gate of the one second switching transistor is configured to receive the fourth control signal.

For example, the step S704 comprises: applying the first control signal having a first level to the first switching device so that the first connection terminal of the first switching device is connected to one second connection terminal of the first switching device, applying the second control signal having a second level to the second switching device so that the first connection terminal of the second switching device is connected to one second connection terminal of the second switching device, applying the third control signal to the one first switching transistor so that the one first switching transistor is turned off, and applying the fourth control signal to the one second switching transistor so that the one second switching transistor is turned off.

For another example, the step S704 comprises: applying the first control signal having a third level to the first switching device so that the first connection terminal of the first switching device is connected to another second connection terminal of the first switching device, applying the second control signal having a fourth level to the second switching device so that the first connection terminal of the second switching device is connected to another second connection terminal of the second switching device, applying the third control signal to the one first switching transistor so that the one first switching transistor is turned off, and applying the fourth control signal to the one second switching transistor so that the one second switching transistor is turned off.

For another example, the step S704 comprises: applying the first control signal having the first level to the first switching device so that the first connection terminal of the first switching device is connected to the one second connection terminal of the first switching device, applying the second control signal having the fourth level to the second switching device so that the first connection terminal of the second switching device is connected to the another second connection terminal of the second switching device, applying the third control signal to the one first switching transistor so that the one first switching transistor is turned off, and applying the fourth control signal to the one second switching transistor so that the one second switching transistor is turned off.

For another example, the step S704 comprises: applying the first control signal having the third level to the first switching device so that the first connection terminal of the first switching device is connected to the another second connection terminal of the first switching device, applying the second control signal having the second level to the second switching device so that the first connection terminal of the second switching device is connected to the one second connection terminal of the second switching device, applying the third control signal to the one first switching transistor so that the one first switching transistor is turned off, and applying the fourth control signal to the one second switching transistor so that the one second switching transistor is turned off.

For another example, the step S704 comprises: applying the first control signal to the first switching device so that the first connection terminal of the first switching device is connected to a second connection terminal of the first switching device, applying the second control signal to the second switching device so that the first connection terminal of the second switching device is connected to a second connection terminal of the second switching device, applying the third control signal to the one first switching transistor so that the one first switching transistor is turned on, and applying the fourth control signal to the one second switching transistor so that the one second switching transistor is turned on.

In some embodiments, the third control signal is the same as the fourth control signal.

In some embodiments, the first switching sub-circuit comprises a plurality of third switching transistors, and the second switching sub-circuit comprises a plurality of fourth switching transistors. The mode selecting signal comprises a plurality of fifth control signals and a plurality of sixth control signals. A plurality of first electrodes of the plurality of third switching transistors are electrically connected to the plurality of first electrodes of the light emitting device in one-to-one correspondence, and a plurality of second electrodes of the plurality of third switching transistors are electrically connected to the pixel driving circuit. A gate of each third switching transistor is configured to receive a fifth control signal corresponding to the each third switching transistor. A plurality of first electrodes of the plurality of fourth switching transistors are electrically connected to the plurality of second electrodes of the light emitting device in one-to-one correspondence, and a plurality of second electrodes of the plurality of fourth switching transistors are electrically connected to a first voltage terminal. A gate of each fourth switching transistor is configured to receive a sixth control signal corresponding to the each fourth switching transistor.

For example, the step S704 comprises: applying one fifth control signal having a low level to one third switching transistor of the plurality of third switching transistors so that the one third switching transistor is turned on, and applying another fifth control signal having a high level to another third switching transistor of the plurality of third switching transistors so that the another third switching transistor is turned off, applying one sixth control signal having a high level to one fourth switching transistor of the plurality of fourth switching transistors so that the one fourth switching transistor is turned off, and applying another sixth control signal having a low level to another fourth switching transistor of the plurality of fourth switching transistors so that the another fourth switching transistor is turned on.

For another example, the step S704 comprises: applying the one fifth control signal having a high level to the one third switching transistor of the plurality of third switching transistors so that the one third switching transistor is turned off, and applying the another fifth control signal having a low level to the another third switching transistor of the plurality of third switching transistors so that the another third switching transistor is turned on, applying the one sixth control signal having a low level to the one fourth switching transistor of the plurality of fourth switching transistors so that the one fourth switching transistor is turned on, and applying the another sixth control signal having a high level to the another fourth switching transistor of the plurality of fourth switching transistors so that the another fourth switching transistor is turned off.

For another example, the step S704 comprises: applying the one fifth control signal having the low level to the one third switching transistor of the plurality of third switching transistors so that the one third switching transistor is turned on, applying the another fifth control signal having the high level to the another third switching transistor of the plurality of third switching transistors so that the another third switching transistor is turned off, applying the one sixth control signal having the low level to the one fourth switching transistor of the plurality of fourth switching transistors so that the one fourth switching transistor is turned on, and applying the another sixth control signal having the high level to the another fourth switching transistor of the plurality of fourth switching transistors so that the another fourth switching transistor is turned off.

For another example, the step S704 comprises: applying the one fifth control signal having the high level to the one third switching transistor of the plurality of third switching transistors so that the one third switching transistor is turned off, applying the another fifth control signal having the low level to the another third switching transistor of the plurality of third switching transistors so that the another third switching transistor is turned on, applying the one sixth control signal having the high level to the one fourth switching transistor of the plurality of fourth switching transistors so that the one fourth switching transistor is turned off, and applying the another sixth control signal having the low level to the another fourth switching transistor of the plurality of fourth switching transistors so that the another fourth switching transistor is turned on.

For another example, the step S704 comprises: applying the plurality of fifth control signals having the low level to the plurality of third switching transistors so that the plurality of third switching transistors are turned on, and applying the plurality of sixth control signals having the low level to the plurality of fourth switching transistors so that the plurality of fourth switching transistors are turned on.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above-described embodiments or equivalently substitution of part of the technical features may be made without departing from the scope and spirit of the present disclosure. The scope of the present disclosure is defined by the appended claims.

What is claimed is:

1. A pixel circuit, comprising:

a pixel driving circuit configured to output a driving current;

a light emitting device configured to emit light having a different brightness according to a different light emitting mode under driving of the driving current and comprising a first electrode structure, a second electrode structure, and a functional layer between the first electrode structure the second electrode structure, wherein the functional layer comprises a light emitting layer, the first electrode structure comprises two first electrodes spaced apart from each other, the second electrode structure comprises two second electrodes spaced apart from each other, the two first electrodes comprise a first sub-electrode and a second sub-electrode, the first sub-electrode comprises a plurality of first comb teeth, and the second sub-electrode comprises a plurality of second comb teeth, wherein a distance between a first comb tooth and a second comb tooth that are close to an edge of the first electrode structure is greater than a distance between a first comb tooth and a second comb tooth that are located in a middle part of the first electrode structure; and a mode selecting circuit configured to select a different light emitting mode according to a different mode selecting signal and comprising:

a first switching sub-circuit electrically connected to the pixel driving circuit and the first electrode structure and configured to perform a different first conduction mode in response to a different mode selecting signal; and a second switching sub-circuit electrically connected to a first voltage terminal and the second electrode structure and configured to perform a different second conduction mode in response to a different mode selecting signal;

wherein the mode selecting circuit is configured to determine the light emitting mode according to the first conduction mode and the second conduction mode;

wherein the first switching sub-circuit is composed of two third switching transistors, and the second switching sub-circuit is composed of two fourth switching transistors;

wherein the mode selecting signal comprises two fifth control signals and two sixth control signals;

wherein two first electrodes of the two third switching transistors are electrically connected to the two first electrodes of the light emitting device in one-to-one correspondence, no other switching transistors are arranged between the two first electrodes of the two third switching transistors, two second electrodes of the two third switching transistors are electrically connected to the pixel driving circuit, and a gate of each of the two third switching transistors is configured to receive a fifth control signal corresponding to the each of the two third switching transistors; and wherein two first electrodes of the two fourth switching transistors are electrically connected to the two second electrodes of the light emitting device in one-to-one correspondence, no other switching transistors are arranged between the two first electrodes of the two fourth switching transistors, two second electrodes of the two fourth switching transistors are electrically connected to the first voltage terminal, and a gate of each of the two fourth switching transistors is configured to receive a sixth control signal corresponding to the each of the two fourth switching transistors.

2. The pixel circuit according to claim 1, wherein:

the light emitting device is on an initial structure layer; and the two second electrodes of the light emitting device comprise a third sub-electrode and a fourth sub-electrode, an orthographic projection of the first sub-electrode on the initial structure layer at least partially overlaps with an orthographic projection of the third sub-electrode on the initial structure layer, and an orthographic projection of the second sub-electrode on the initial structure layer at least partially overlaps with an orthographic projection of the fourth sub-electrode on the initial structure layer.

3. The pixel circuit according to claim 1, wherein:

the light emitting mode comprises a first light emitting mode, a second light emitting mode, and a third light emitting mode;

wherein a light emitting brightness of the light emitting device in the first light emitting mode is less than a light emitting brightness of the light emitting device in the second light emitting mode, and the light emitting brightness of the light emitting device in the second light emitting mode is less than a light emitting brightness of the light emitting device in the third light emitting mode, in a case where the pixel driving circuit is input with a same grayscale data.

4. The pixel circuit according to claim 1, wherein:

the pixel driving circuit comprises a fifth switching transistor, a capacitor, and a driving transistor, wherein a first electrode of the fifth switching transistor is electrically connected to a data signal line, a second electrode of the fifth switching transistor is electrically connected to a gate of the driving transistor, a gate of the fifth switching transistor is electrically connected to a gate control line, a first terminal of the capacitor is electrically connected to the gate of the driving transistor, a second terminal of the capacitor is electrically connected to a second voltage terminal, a first electrode of the driving transistor is electrically connected to the second voltage terminal, and a second electrode of the driving transistor is electrically connected to the mode selecting circuit.

5. The pixel circuit according to claim 2, wherein:

an area of the first sub-electrode is equal to an area of the second sub-electrode, and an area of the third sub-electrode is equal to an area of the fourth sub-electrode, in a direction parallel to an extension direction of the functional layer.

6. A display device, comprising: a plurality of pixel circuits according to claim 1.

7. The display device of claim 6, further comprising:

a timing controller configured to provide mode selecting signals to the plurality of pixel circuits in one-to-one correspondence.

* * * * *